United States Patent [19]

King et al.

[11] Patent Number: 4,984,690

[45] Date of Patent: Jan. 15, 1991

[54] FOOD CONTAINER STACKING DEVICE

[75] Inventors: Frederick M. King, Minneapolis; Harry F. Collins, Minnetonka, both of Minn.

[73] Assignee: Service Ideas, Inc., Minneapolis, Minn.

[21] Appl. No.: 398,945

[22] Filed: Aug. 28, 1989

[51] Int. Cl.[5] ..... B65D 85/62; A47F 1/00

[52] U.S. Cl. ..... 206/503; 206/501; 206/511; 206/821; 211/59.4; 211/175; 211/188; 211/194; 248/172

[58] Field of Search ..... 206/503, 499, 511, 512, 206/509, 821, 501; 248/172, 346; 211/186, 175, 105.3, 59.4, 188, 194; 40/657; 414/900

[56] References Cited

U.S. PATENT DOCUMENTS

| | | | |
|---|---|---|---|
| 463,667 | 11/1891 | Meisenbach | 211/175 X |
| 1,272,175 | 7/1918 | Albright | 211/175 X |
| 2,377,803 | 6/1945 | Monver | 206/821 X |
| 2,431,423 | 11/1947 | Robbins | 211/175 X |
| 2,565,782 | 8/1951 | Rhodes | 206/501 |
| 2,942,734 | 6/1960 | Paddock | 206/821 X |
| 3,091,348 | 5/1963 | Neuhauser | 211/59.4 X |
| 3,543,951 | 12/1970 | Marvin | 206/503 |
| 3,891,091 | 6/1975 | Anderson | 211/105.3 |
| 4,405,051 | 9/1983 | Thakenfeld | 40/657 X |

FOREIGN PATENT DOCUMENTS

| | | | |
|---|---|---|---|
| 2456768 | 6/1975 | Fed. Rep. of Germany | 206/821 |

*Primary Examiner*—Bryon P. Gehman

*Attorney, Agent, or Firm*—Moore & Hansen

[57] ABSTRACT

A simple device for separating pans of food stored in a vertical array, preventing the contents of the pan below from contacting the bottom of the pan above. The pan stacking device is used two at a time along with conventional food storage pans as commonly found in the food preparation industry. The ends of the devices include preferably intermittent or staggered shoulders for fitting snugly to the flange rims of the pan below and the outer surface of the pan above, thereby maintaining the stacked pans in relatively sturdy, stable position. The preferred embodiment of the pan stacking device is adjustable so as to fit food storage pans and containers of various sizes.

6 Claims, 1 Drawing Sheet

FOOD CONTAINER STACKING DEVICE

BACKGROUND OF THE INVENTION

1. Technical Field

This invention relates to stacking devices which permit various objects of identical or nearly identical configuration to be placed in a resting position one on top of another for neat, efficient storage during periods of non-use, without requiring the additional use of a rack or other device which rests on a floor or shelf. Specifically, this invention relates to a stacking bar enabling the easy vertical arrangement of various sized pans or containers conventionally used in the course of preparation of large quantities of food, especially in commercial settings such as restaurants and institutions, whereby pans may be stacked one above another without the bottom surface of the pan above coming into contact with the contents of the pan below.

2. Background Information

It is a common practice in restaurants to prepare large quantities of food in advance of actual meal times and place them in pans which are stored in refrigerators until the food is to be served. The pans, which tend to be of standard sizes and configuration throughout the food service industry, cannot be stacked one on top of the other because the bottom of one pan would come into contact with the food in the pan below. The pans may be stacked in a criss-cross arrangement, but this takes up an excessive amount of space in refrigerators and on countertops.

Several forms of stacking devices have been developed to provide for stacking similar items one above another, and in general these stacking devices are configured for specific purposes other than stacking food containers.

For example, U.S. Pat. No. 3,228,857 issued to McCormick on Jan. 11, 1966 facilitates the stacking of petri dishes and their covers. However, there are few other applications available for a device of the specific configuration disclosed, and it would not be at all useful for stacking pans of prepared food as envisioned by the present invention. Further, this reference does not provide for size adjustment to accommodate various sizes of the object to be stacked.

U.S. Pat. No. 2,942,734 issued to Paddock on June 28, 1960 relates to a device which may be used in the storage of packaged bakery goods, inter alia. However, this device requires actual attachment to one of the items being stacked, and the size of the stacking device is not adjustable to accommodate various sizes, shapes and configurations of stacked items.

U.S. Pat. No. 3,379,314 issued to Canning on June 17, 1966 discloses a stacking device directed toward the vertical storage arrangement of canoes. Unlike other prior art references, the supports disclosed in the Canning reference are adjustable to accommodate various size canoes. Further, the Canning device is also generally used in pairs. However, the Canning device is also cumbersome to work with, requiring the removal and reinsertion of bolts in order to adjust the length of the supports.

With this background in mind, an easy to use food pan stacking device has been developed.

SUMMARY OF THE INVENTION

The present invention is intended to provide an easy means for storing objects, primarily containers of food, in a vertical arrangement without requiring bulky, cumbersome, floor-standing carts or other free-standing storage cabinets which do not provide the flexibility needed to permit the temporary storage of food storage pans and containers of various sizes and shapes. The invention is easy to manufacture, using commonly found, inexpensive materials, is lightweight and easily adjusted for various size containers. Further, it is easy to clean and will not corrode, decay or rust. It is also sturdy and capable of handling heavy loads without toppling.

The invention is uniquely adapted for use with commonly found food storage pans already widely used throughout the food service industry. These rectangular, stainless steel pans which have four vertical side walls and an outwardly extending, horizontal flange rim around the upper edge of these walls, are filled with food in a cooked or partially cooked state. The pans are then stored in a food storage location such as on a counter or in a refrigerator. An object of the invention is to provide a means for efficiently using space in this food storage location. The pan stacking bars allow the rectangular pans to be vertically arranged in a space-efficient manner. This is accomplished by sizing and shaping the pan stacking bars so as to provide a horizontal top surface and a horizontal bottom surface between end wall segments spaced apart predetermined distances, whereby the bottom surface of a pan is snugly received on the horizontal top surface and the flange rim on a pan below is snugly accommodated and received on the horizontal bottom surface between the end wall segments.

Advantageously, the stacking bar may be formed from two elongate support elements slidably assembled together in such a way as to be adjustable lengthwise for the purpose of accommodating pans of varying widths.

A further object of this invention is to provide a means for identifying the contents of individual food storage pans, the date on which the food was prepared, and any other information a user may wish to display.

These and further objects and advantages of the invention will be readily understood as the following description is read in conjunction with the accompanying drawings, wherein like reference numerals have been used to designate like elements throughout the several views.

DESCRIPTION OF THE PREFERRED EMBODIMENT

Figures 1, 2, 3, 4, 5:
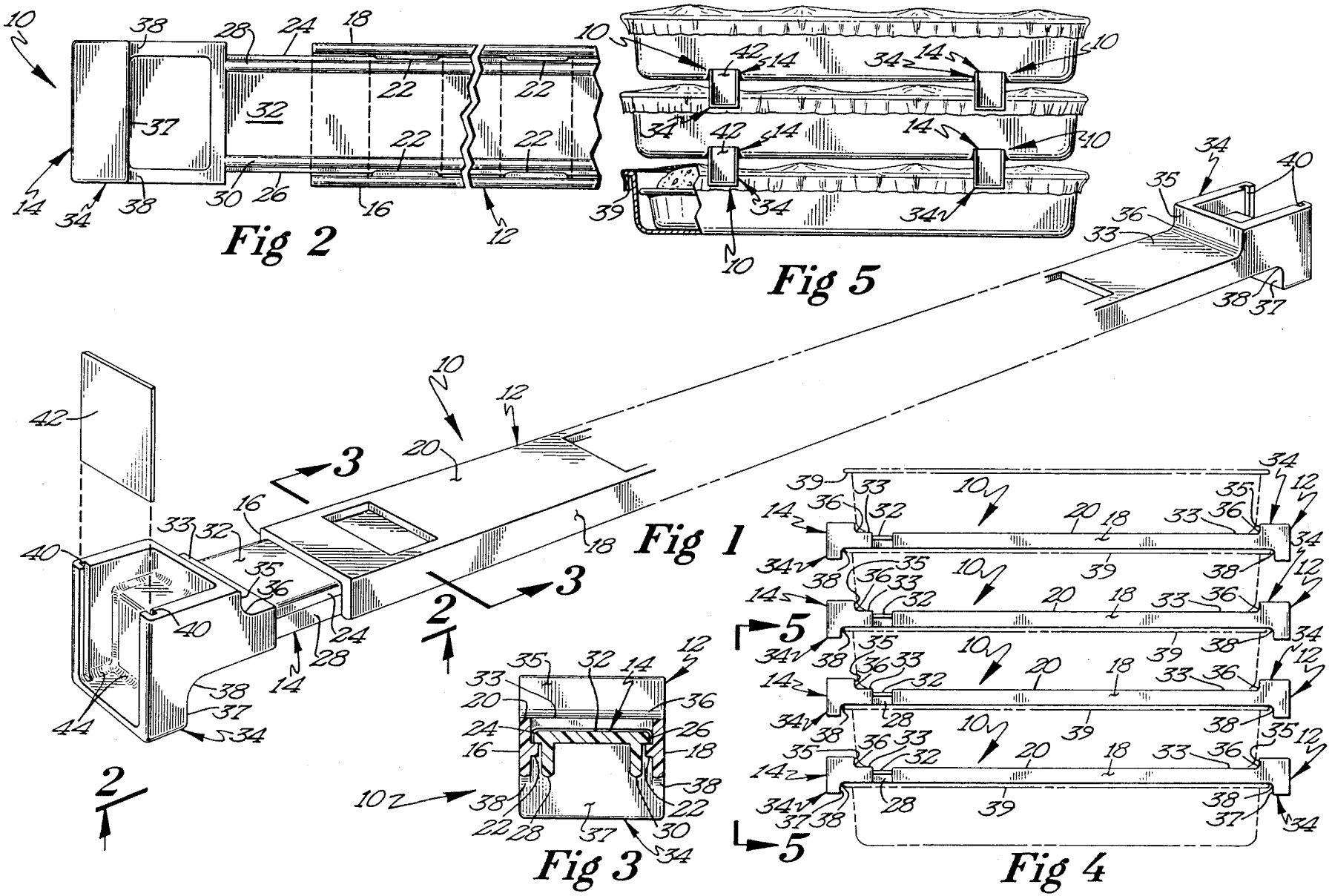
FIG. 1 is a perspective view of the preferred embodiment of the stacking bar invention.
FIG. 2 is a fragmentary, bottom view of the lower side of the stacking bar of FIG. 1 showing an end thereof taken along line 2—2 of FIG. 1.
FIG. 3 is a vertical section view of the stacking bar taken along line 3—3 of FIG. 1.
FIG. 4 is an end view of a stack of food storage pans using the supports of the invention.
FIG. 5 is a side elevation view of a stack of food storage pans taken along line 5—5 of FIG. 4.

With reference to the drawings, and in particular to FIG. 1, the stacking device of the invention is generally indicated by reference numeral 10. The major elements of the invention are the first elongate support element 12 and the second elongate support element 14. Both of these elements are preferably molded from nylon, although embodiments of other plastics such as polycarbonate, and even wood may be envisioned within the scope of the invention.

As may be seen in FIGS. 2 and 3, the first support element 12 includes vertical side walls 16, 18 extending downward from horizontal support wall 20. Shoulders 22 on the inner surface of side walls 16, 18 of first support element 12 define slots along the upper edge of the side walls 16, 18 adjacent the bottom of support wall 20. The shoulders 22 may be continuous along the inner surface of side walls 16, 18, or they may be intermittent or staggered. The slots defined by shoulders 22 and the horizontal support wall 20 are provided as a means for retaining the second support element 12 therein, as shall be explained.

As may be further seen in FIGS. 2 and 3, the second support element 14 is slidably engaged with the first support element 12. The means for retaining second support element 14 within first support element 12 includes peripheral projections or shoulder rails 24, 26 which extend laterally beyond first and second support walls 28 and 30, respectively. The shoulder rails 24, 26 are extensions of horizontal wall 32, and are slidably supported on shoulders 22 within the slots defined between shoulders 22 and horizontal support wall 20 of the first support element 12. The shoulder rails 24, 26 are not essential to the operation of the adjustable pan stacking device 10, but they provide added strength to the assembly, and help ensure that the second support element 14 is properly positioned with respect to the first support element 12. When in use, horizontal wall 32 is positioned in facing, parallel juxtaposition to the support surface 20 of the first support element 12.

At one end of both the first support element 12 and second support element 14 is an end structure 34. Each end structure 34 has a generally upright end wall surface 35 defining shoulder 36. The shoulder 36 of the first support element 12 joins and intersects support surface 20, and the shoulder 36 of the second support element 14 joins and intersects horizontal wall segment 33 adjacent to horizontal wall 32. Each end structure 34 also has a downwardly depending wall surface 37 defining lower flange shoulder 38. These end structures 34 of the support elements 12 and 14 cooperate to determine the length 36—36 of a top support surface 33, 20 on which the stored pans rest, as well as the length 38—38 of the underside of the pan stacking device 10, which rests on the upper edges and flange rims 39 of the vertically aligned pans (FIGS. 4 and 5). Pan shoulders 36 define distance 36—36, and flange shoulders 38 define distance 38—38. As may best be seen in FIG. 4, the distance 36—36 may be adjusted to fit snugly about the outside bottom surface of the pan. This adjustment also provides for snug relation to the flange rim 39 of the next lower pan in a stack of pans. The adjustment of the aforesaid distances is made by slidably moving support elements 12 and 14 longitudinally with respect to each other. When the invention is used with standard size pans as found in most restaurants and other institutions where large quantities of food are prepared support elements 12 and 14 will be slidably positioned together with horizontal surface segment 33 abutting top support surface 20. This provides continuous top and bottom support surfaces with minimum distances 36—36 and 38—38.

Also located on end structures 34 is a display support means including a pair of peripheral, inwardly disposed, opposed retention grooves 40 and an identification card 42 which may be slidably inserted into and removed from grooves 40 for providing information such as the identity of the contents stored in a stacked container of food or the date on which the food was prepared, for example. It is also important to provide the inner corners 44 of end structure 34 with rounded surfaces for purposes of better and easier cleaning of food and cooking matter that may become trapped therein. The radiused shoulders 36 and 38 serve the same purpose.

Another embodiment of the invention includes the functional features of the end structures 34 of the invention, but lacks the features related to adjustability. This embodiment, although not slidably adjustable, may be provided in a number of standard sizes covering the range of sizes in which the standard food storage pans are found.

In operation, two pan stacking devices 10 are used to support a food storage pan atop another food storage pan. The adjustable embodiment of the pan stacking device 10 may be put into use quickly and easily. The first step is to assemble first and second support elements 12 and 14 into a single pan stacking device 10. The shoulder rails 24, 26 of the second support element 14 are first aligned with and then inserted into the slot defined between the shoulders 22 and the support wall 20 of the first support element 12. The length of the pan stacking device 10 is then adjusted to a desired length by sliding the second support element 14 within the first support element 12 to a desired length. In most cases this length will be determined by the distance between the outside edges of the horizontal flange rim 39 of the pan on which the pan stacking device 10 will be placed. The size of the pan stacking device 10 may be adjusted to span either width of the pan below, including the distance between the outside edges of the flange rims, between the flange shoulders 38 of the opposing end structures 34 of the support elements 12 and 14. A second pan stacking device 10 will then be prepared in the same manner. The two pan stacking devices will than be placed generally parallel and spaced apart from each other transversely across the lower pan, with the support surface 20 exposed and facing upward to serve as a resting surface for a pan to be stacked thereon and with the shoulders 38 snugly engaging the opposite sides of flange rim 39. This process is repeated until a suitable number of pans have been stacked in the vertical array of pans. The array of stacked pans may vary with different sizes and numbers of pans being stacked in any suitable arrangement.

Likewise, when using the alternative, nonadjustable embodiment of the invention, the pan stacking device 10 will be positioned to span the width of the pan below, placed so that the pan flange rims are just inside of and adjacent to the flange shoulders 38 of the opposing end structures 34 of the pan stacking device 10. A second pan stacking device will then be placed generally parallel and spaced apart from the first stacking device, across the lower pan, with the support surface 20 exposed and facing upward to serve as a resting surface for a pan to be stacked thereon. As with the adjustable version of the invention, this process is repeated until a suitable number of pans have been stacked in the vertical array of pans.

Although the stacking device has been described with respect to the particular application for stacking pans, it is contemplated that the device will have application to the stacking and separation of various types and shapes of food containers, such as fresh and/or frozen food cartons and refrigerated produce packages. All of such food containers must be stacked when stored, and preferably with room for air circulation between the containers.

It is anticipated that various changes may be made in the size, shape, and construction of the pan stacking device disclosed herein without departing from the spirit and scope of the invention as defined by the following claims.

What is claimed is:

1. A food container stacking device, comprising:

a first elongate support element including first and second vertical walls, a first horizontal wall extending therebetween, and a first end structure on one end thereof;

a second elongate support element slidably engaged with said first support element, said second support element including a second horizontal wall extending in facing, parallel juxtaposition to said first horizontal wall, and a second end structure on one end thereof at the opposite end of the food container stacking device from said first end structure;

said second support element is contained within said first support element with said second horizontal wall disposed under said first horizontal wall;

said first support element includes means for retaining said second support element therein;

said second support element includes means for cooperative engagement with said means for retaining said second support element within said first support element;

said means for retaining said second support element within said first support element includes at least one shoulder extending inwardly from each of said first and second vertical walls of said first support element, said shoulders defining a slot between said shoulders and said first horizontal wall of said first support element; and said second support element means for cooperative engagement with said means for retaining said second support element within said first support element includes at least one pair of outwardly extending peripheral projections on opposite sides of said second horizontal wall for cooperative, slidable engagement with said shoulders of said first support element.

2. A food container stacking device, comprising:

a first elongate support element including first and second vertical walls, a first horizontal wall extending therebetween, and a first end structure on one end thereof;

a second elongate support element slidably engaged with said first support element, said second support element including a second horizontal wall extending in facing, parallel juxtaposition to said first horizontal wall, and a second end structure on one end thereof at the opposite end of the food container stacking device from said first end structure; and said first and second end structures each have a first generally upright end wall surface, said end wall surface of said first end structure joining said first horizontal wall and said end wall surface of said second end structure joining said second horizontal wall, and a second, downwardly depending wall surface, said first end wall surfaces of said first and second end structures being spaced apart a first distance to receive and contain therebetween a container base wall and said second, downwardly depending wall surfaces of said first and second end structures being spaced apart a distance greater than said first distance sized to accommodate and receive therebetween a peripheral flange rim on the container, whereby a plurality of food containers may be vertically stacked with at least one of said stacking devices between vertically adjacent containers.

3. A stacking device as defined in claim 2, wherein:

said end surfaces on top of said end structures are radiused to form curved base corners within which the curved bottom edges of the containers may be received.

4. A food pan stacking device, for use with open-top food pans having four generally upright side walls joining a base wall and a top, peripheral flange rim projecting laterally outwardly beyond the side walls of the pan, comprising:

elongated, pan support bar means having a top surface for receiving a pan base wall in resting engagement therewith;

an end wall structure at each end of said bar means, each of said end wall structures having a first, generally upright end wall surface joining said top surface and a second, downwardly depending wall surface, said first end wall surfaces being spaced apart a first predetermined distance to receive and contain therebetween the pan base wall and said second, downwardly depending wall surfaces being spaced apart a second predetermined distance greater than said first predetermined distance sized to accommodate and receive therebetween the peripheral flange rim on a pan, whereby a plurality of food pans may be vertically stacked with at least one of said stacking devices between vertically adjacent pans and with the base wall of each pan resting on the top surface of said support bar means between said first end wall surfaces of a stacking device and with the flange rim of each pan disposed between the second, downwardly depending wall surfaces of a stacking device; and said elongated pan support bar means comprises a first elongate support element having one of said pair of end wall structures at one end thereof and a first horizontal wall defining said top surface, and a second elongate support element slidably engaged with said first support element and having the other one of said pair of end wall structures on one end thereof and having a second horizontal wall.

5. A food pan stacking device as defined in claim 2, wherein:

said second horizontal wall extends in facing, parallel juxtaposition to said first horizontal wall.

6. A food pan stacking device as defined in claim 5, and further comprising:

means on said first support element for slidably retaining said second support element, and means on said second support element slidably engaged with said retaining means.

* * * * *